US010271574B2

(12) United States Patent
Rasouli et al.

(10) Patent No.: US 10,271,574 B2
(45) Date of Patent: Apr. 30, 2019

(54) LIQUID TOBACCO COMPOSITION

(71) Applicant: Philip Morris Products S.A., Neuchatel (CH)

(72) Inventors: Firooz Rasouli, Midlothian, VA (US); Gianluca Sechi, Colombier (CH); Irfan Gunduz, Lemont-sur-lausanne (CH)

(73) Assignee: Philip Morris Products S.A., Neuchatel (CH)

( * ) Notice: Subject to any disclaimer, the term of this patent is extended or adjusted under 35 U.S.C. 154(b) by 1113 days.

(21) Appl. No.: 14/387,611

(22) PCT Filed: Mar. 15, 2013

(86) PCT No.: PCT/IB2013/052095
§ 371 (c)(1),
(2) Date: Sep. 24, 2014

(87) PCT Pub. No.: WO2013/144766
PCT Pub. Date: Oct. 3, 2013

(65) Prior Publication Data

US 2015/0083143 A1 Mar. 26, 2015

Related U.S. Application Data

(60) Provisional application No. 61/616,481, filed on Mar. 28, 2012.

(30) Foreign Application Priority Data

Mar. 28, 2012 (EP) ..... 12161720

(51) Int. Cl.
*A24B 15/38* (2006.01)
*A24B 15/24* (2006.01)
(Continued)

(52) U.S. Cl.
CPC ..... *A24B 15/385* (2013.01); *A24B 15/245* (2013.01); *A24B 15/246* (2013.01);
(Continued)

(58) Field of Classification Search
CPC ..... A24B 15/24
(Continued)

(56) References Cited

U.S. PATENT DOCUMENTS 5,810,020 A * 9/1998 Northway ..... A24L 315/26 131/297
2002/0134394 A1 9/2002 Baskevitch et al.
(Continued)

FOREIGN PATENT DOCUMENTS

CN 102 304 865 A 1/2012
DE 102007035322 A1 1/2009
(Continued)

OTHER PUBLICATIONS

"TSNA," NCI Dictionary of Cancer Terms, 2018, National Cancer Institute, <https://www.cancer.gov/publications/dictionaries/cancer-terms/def/tsna> (Year: 2018).*
(Continued)

*Primary Examiner* — Michael H. Wilson
*Assistant Examiner* — Yana B Krinker
(74) *Attorney, Agent, or Firm* — Mueting, Raasch & Gebhardt P.A.

(57) ABSTRACT

A liquid tobacco composition comprises tobacco dissolved in an ionic liquid. Removal of selected tobacco constituents is aided by dissolving the tobacco in the ionic liquid. The tobacco, having selected constituents removed, may be regenerated from the liquid tobacco composition by separating the tobacco from the ionic liquid.

9 Claims, 1 Drawing Sheet

(51) Int. Cl.
*A24B 15/26* (2006.01)
*A24B 15/28* (2006.01)
*A24D 1/00* (2006.01)

(52) U.S. Cl.
CPC ..... *A24B 15/26* (2013.01); *A24B 15/28* (2013.01); *A24D 1/00* (2013.01)

(58) Field of Classification Search
USPC ..... 131/297
See application file for complete search history.

(56) References Cited

U.S. PATENT DOCUMENTS

2008/0188636 A1* 8/2008 Argyropoulos ..... C08H 8/00 527/300
2010/0163018 A1* 7/2010 Gifford ..... C08B 1/003 127/37

FOREIGN PATENT DOCUMENTS

WO WO 01/65954 A1 9/2001
WO WO 2006/059229 A1 6/2006
WO WO2006059229 * 6/2006 ..... A24B 15/24
WO WO 2010/107375 A1 9/2010

OTHER PUBLICATIONS

International Search Report and Written Opinion for PCT/IB2013/052095, issued by the European Patent Office as the International Search Authority dated Jul. 11, 2013; 9 pgs.
International Preliminary Report on Patentability issued by The International Bureau of WIPO for PCT/IB2013/052095, dated Oct. 9, 2014; 6 pgs.
Badrossanay et al., "Nanofiber Assembly by Rotary Jet-Spinning," *Nano Lett,* May 21, 2010;10:2257-2261.
Broughton et al., "Investigation of Organic Liquids for Fiber Extrusion—NTC Project: C05-AE05" *National Textile Center Annual Report,* 2009: 7 pgs.
Turner et al., "Production of Bioactive Cellulose Films Reconstituted from Ionic Liquids," *Biomacromolecules,* Jum. 22, 2004;5(4):1379-1384.
Zhu et al., "Dissolution of cellulose with ionic liquids and its application: a mini review," *Green Chemistry,* Mar. 13, 2006;8:325-327.

* cited by examiner

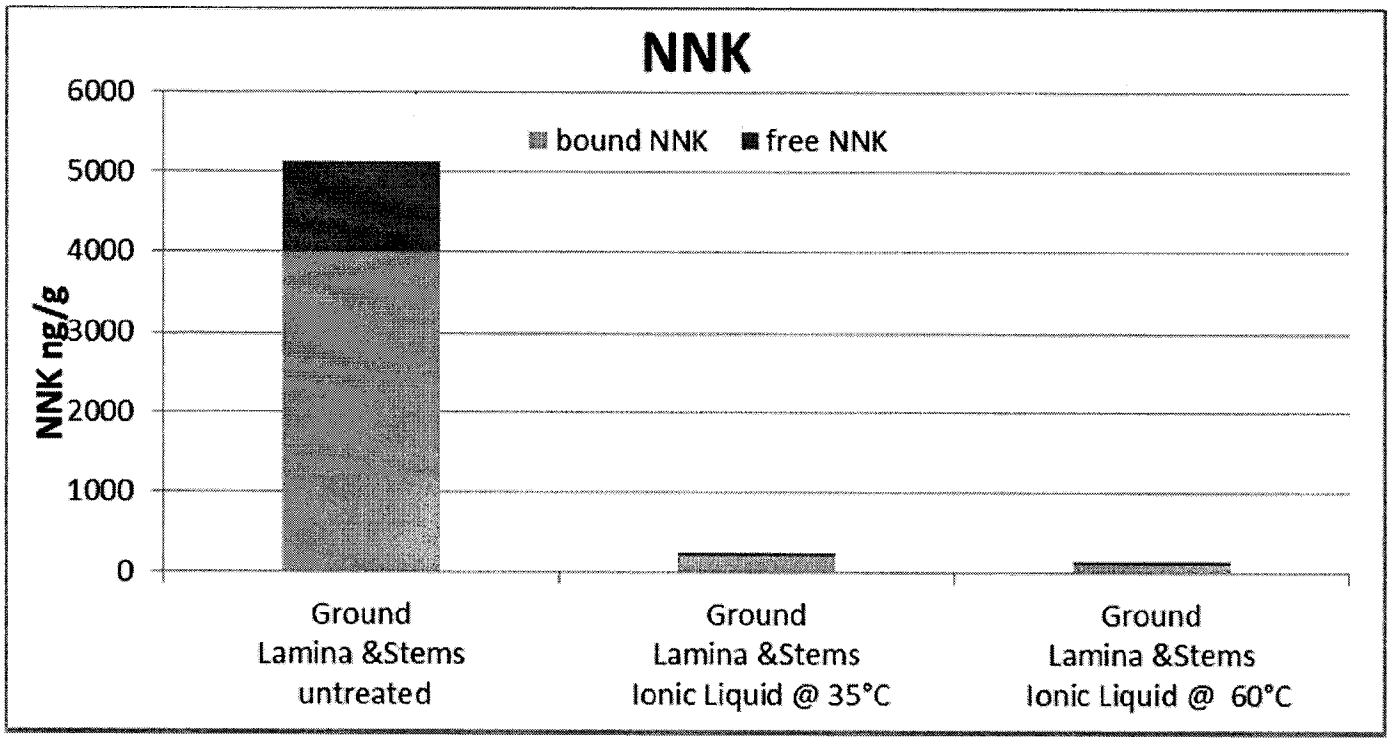
NNK
bound NNK
free NNK
NNK ng/g
6000
5000
4000
3000
2000
1000
0
Ground Lamina &Stems untreated
Ground Lamina &Stems Ionic Liquid @ 35°C
Ground Lamina &Stems Ionic Liquid @ 60°C

LIQUID TOBACCO COMPOSITION

This disclosure relates to liquified tobacco, particularly tobacco dissolved in an ionic liquid, and regeneration of liquified tobacco into solid tobacco products.

Extensive research has been conducted on tobacco and tobacco constituents. In many cases, it has been determined that it is desirable to reduce the levels of certain constituents, such as tobacco-specific nitrosamines, in the final tobacco product. Current methods for reducing levels of such constituents of tobacco include incubating tobacco with a solvent in which the constituents are soluble to extract the constituents from the tobacco. However, such processes tend to be inefficient due, at least in part, to poor penetration of the solvent into the tobacco or the inability to fully extract constituents bound to non-soluble portions of the tobacco, such as cellulose. More efficient removal of constituents of tobacco, such as tobacco-specific nitrosamines, would be desirable.

However, increased efficiency or effectiveness of removal of such constituents may result in the removal of desired constituents of tobacco or may negatively affect desired physical or chemical properties of the tobacco. Accordingly, it may be desirable to produce tobacco or tobacco products having reduced amounts of selected constituents, while retaining desired constituents or characteristics.

FIG. 1 is a bar graph showing amounts of bound and free 4-(methylnitrosamino)-1-(3-pyridyl)-1-butanone (NNK) in untreated ground tobacco lamina and stems (GLS) and treated GLS.

As described herein, tobacco is completely or partially dissolved in a solvent, such as an ionic liquid. Once the tobacco is dissolved, selected constituents of the tobacco may be removed. Once the selected constituents are removed, the tobacco may be regenerated. The constituents and characteristics of the regenerated tobacco material may be controlled to provide tobacco or a tobacco articles with desired characteristics.

Solutions or suspensions of fully or partially dissolved tobacco may provide one or more advantages relative to solid tobacco particles. For example and as described above, the ability to remove selected constituents of tobacco may be enhanced. Such solutions or suspensions may additionally or alternatively allow for more thorough chemical analysis of tobacco constituents, which analysis is currently limited to solid particles through burning or extraction.

Regeneration of tobacco from such solutions or suspensions may also provide one or more advantages relative to tobacco that it not dissolved. By way of example, the physical or chemical properties of the resulting tobacco, such as size, shape, taste, etc., may be controlled through the regeneration process, allowing for the production of tobacco or tobacco articles with tailored properties.

Tobacco may be dissolved in any suitable solvent. It has been found that ionic liquids may serve as suitable solvents for complete or partial dissolution of tobacco, including the cellulose components of tobacco. Any suitable ionic liquid may be used as a solvent to dissolve tobacco. As used herein, an "ionic liquid" is an ionic compound in a liquid state. An ionic compound may be a compound having positively and negatively charged moieties, such as N-methylmorphione-N-oxide (NMMO), or a salt. Suitable ionic liquids typically have melting points of about 150° C. or less, such as about 100° C. or less. In embodiments, the ionic liquid has a melting temperature of about 40° C. or less, such as about 25° C. or less, about 23° C. or less, about 20° C. or less, about 15° C. or less, about 10° C. or less, about 5° C. or less, about 0° C. or less, about −10° C. or less, about −20° C. or less, or about −30° C. or less. Ionic liquids are typically liquid over a wide temperature range from the melting point to the decomposition temperature. Preferably, the ionic liquids are liquid at room temperature; i.e., have a melting temperature of less than about room temperature, which is typically considered to be between about 20° C. and about 25° C. More preferably, the ionic liquids are liquid at temperatures 10° C. or more below room temperature, such as below about 15° C., or below about 10° C. Most preferably, the ionic liquids are liquid at a temperature of below about 0° C., such as below about −10° C. or below about −20° C. By way of example, one suitable ionic liquid, 1-ethyl-3-methylimidazolium acetate, has a melting temperature of about −20° C.

In many embodiments, ionic liquids are salts. Examples of cation moieties of ionic liquid salts include cyclic and acyclic cations. Cyclic cations include pyridinium, imidazolium, and imidazole. Acyclic cations include alkyl quaternary ammonium and alkyl quaternary phosphorous cations. Substituent groups, (i.e. R groups), on the cations can be $C_1$, $C_2$, $C_3$, and $C_4$, which may be saturated or unsaturated. The ionic liquid salt may have any suitable counter anion. In embodiments, counter anions of the cation moiety are selected from the group consisting of halogen, pseudo-halogen and carboxylate. Carboxylates include acetate, citrate, malate, maleate, formate, and oxylate. Halogens include chloride, bromide, zinc chloride/choline chloride, 3-methyl-N-butyl-pyridinium chloride and benzyldimethyl (tetradecyl) ammonium chloride.

Examples of compounds which are ionic liquids and which may be used to dissolve tobacco include, but are not limited to, NMMO, 1-ethyl-3-methylimidazolium chloride, 1-allyl-3-methylimidazolium chloride, 1-butyl-3-methylimidazolium chloride, 1-ethyl-3-methylimidazolium methanesulfonate, 1-ethyl-3-methylimidazolium diethylphosphate, 1,3-dimethylimidazolium dimethylphosphate, 1-ethyl-3-methylimidazolium acetate, 1-butyl-3-methylimidazolium chloride, 1-butyl-3-methylimidazolium methylcarbonate, and tris-(2-hydroxyethyl)-methylammonium methylsulfate.

Tobacco may be dissolved, fully or partially, in an ionic liquid at any suitable concentration to obtain a liquid tobacco composition. As used herein, a "liquid tobacco composition" is a liquid composition that has at least some amount of tobacco, including the cellulose components, completely dissolved. In embodiments, the liquid tobacco composition comprises greater than about 1% tobacco by weight, such as greater than about 2% by weight, or greater than about 5% by weight. In embodiments, the liquid tobacco composition comprises less than about 90% by weight tobacco, such as less than about 75% by weight tobacco, less than about 50% by weight tobacco, or less than about 30% by weight tobacco. In embodiments, the liquid tobacco composition comprises from about 1% to about 90% by weight tobacco, such as from about 5% to about 25% by weight tobacco, or about 10% by weight tobacco. As used herein, "tobacco" means leaves, stems, or other portions of any of several plants belonging to the genus *Nicotiana*, such as of the species *N. tabacum*, or by-products generated during threshing of the leaves or during manufacture of tobacco articles. Preferably, tobacco includes leaves, stems or leaves and stems.

The tobacco may optionally be dried before being dissolved in the ionic liquid. The tobacco may be dried in any suitable manner, such as heating to facilitate evaporation, freeze-drying or the like. In embodiments, the weight percent of tobacco dissolved in the ionic liquid is calculated based on the dry weight of the tobacco.

The tobacco may be ground, cut, shred, or the like to facilitate dissolution in the ionic liquid. The resulting composition comprising the tobacco and ionic liquid may be heated, stirred, sonicated, or the like to aid in dissolving the tobacco in the ionic liquid. Under a given set of conditions, such as tobacco particle size, weight percent, temperature, stirring, or the like, with a given ionic liquid, the tobacco will completely dissolve in a given amount of time.

In embodiments, the tobacco is partially dissolved in the ionic liquid. Partial dissolution may be obtained by varying the temperature, time, stirring, etc. of the liquid tobacco composition. The tobacco may be partially dissolved to any suitable or desired extent. For example, the tobacco may be dissolved for an amount of time equivalent to about 10% or less of the amount of time needed for complete dissolution under a given set of conditions. In embodiments, the tobacco may be dissolved for an amount of time equivalent to about 20% or less, about 30% or less, about 40% or less, about 50% or less, about 60% or less, about 70% or less, about 80% or less, or about 90% or less of the amount of time needed for complete dissolution under a given set of conditions. The resulting liquid tobacco composition with partially dissolved tobacco may be cooled to slow or arrest further dissolution of the tobacco until further processing of the liquid tobacco solution. Without intending to be bound by theory, it is believed that partial dissolution of tobacco may allow for some opening, thinning, or increased permeability of the cellular structure to provide access for removal of selected constituents, such as tobacco-specific nitrosamines, while maintaining many of the physical and chemical attributes of the tobacco.

Once the liquid tobacco composition with fully or partially dissolved tobacco is obtained, constituents of the tobacco may be removed or the tobacco may be regenerated. Preferably, constituents are removed prior to or during regeneration of the tobacco. Any constituent may be removed. The liquid tobacco compositions described herein may be subjected to any of a variety of known or future developed processes to remove or reduce the concentration of one or more constituents. Such reduction in concentration may be achieved in the liquid tobacco composition or may be achieved when comparing the original tobacco to tobacco regenerated from the liquid tobacco composition.

In embodiments, the concentration of one or more nitrosamine in a liquid tobacco composition is reduced. Nitrosamines that may be removed or reduced include tobacco-specific nitrosamines, such as N'-nitrosonornicotine (NNN), 4-(methylnitrosamino)-1-(3-pyridyl)-1-butanone (NNK), 4-(methylnitrosamino)-1-(3-pyridyl)-1-butanol (NNAL), N'-nitrosoanatabine, and N'-nitrosoanabasine. A high percentage of certain tobacco-specific nitrosamines, such as NNK, are present in tobacco in bound form and are not readily extractable using existing methodologies. The inventors have found that, by dissolving tobacco in an ionic liquid, substantial amounts of bound nitrosamines, such as NNK, can be removed from the dissolved tobacco and that tobacco regenerated from such treated dissolved tobacco can contain substantially reduced amounts of bound nitrosamine relative to the original tobacco.

Any amount of nitrosamine may be removed from tobacco according to the methods described herein. In embodiments, amounts of a nitrosamine in regenerated tobacco material is reduced about 2-fold or more relative to the original tobacco, where the regenerated tobacco material is regenerated from an ionic liquid tobacco composition from which the nitrosamine is removed. For example, the amounts of the nitrosamine in the regenerated tobacco material may be reduced about 5-fold or more, about 10-fold or more, or about 20-fold or more relative to the original tobacco. Such reductions may be reductions in free nitrosamines, bound nitrosamines, or free and bound nitrosamines.

Nitrosamines may be removed or reduced by contacting the liquid tobacco composition with a tobacco-specific nitrosamine-reducing material, such as a sorbent configured to adsorb or absorb nitrosamines. The tobacco-specific nitrosamine-reducing material may be a trapping sink that comprises a select transition metal complex which is readily nitrosated to form a nitrosyl complex with little kinetic or thermodynamic hinderance, such as described in, for example, U.S. Pat. No. 5,810,020 to Northway, et al. The tobacco-specific nitrosamine-reducing material may be a material as described in, for example, US Patent Application Publication No. 2002/0134394 to Baskevitch, et al. For example, the tobacco-specific nitrosamine-reducing material may be selected from the group consisting of charcoal, activated charcoal, zeolite, sepiolite, and combinations thereof. The tobacco-specific nitrosamine-reducing material may also possess certain characteristics that enhance its ability to remove nitrosamines from the tobacco. For example, in embodiments, the tobacco-specific nitrosamine-reducing material has a surface area greater than about 600 square meters per gram, and in some embodiments, greater than about 1000 square meters per gram. In some embodiments, the tobacco-specific nitrosamine-reducing material includes pores, channels, or combinations thereof, which have a mean diameter larger than about 3.5 angstroms, and in some embodiments, larger than about 7 angstroms.

In embodiments, the concentration of one or more precursor of benzo[a]pyrene (BaP) in a liquid tobacco composition is reduced. As used herein, a "precursor of BaP" is a compound that contributes to the formation of BaP when tobacco is burned. Any suitable method for removing precursors of BaP may be employed. For example, a precursor of BaP may be extracted from a liquid tobacco composition with a solvent in which the precursor of BaP is soluble. Such solvents include solvents described in, for example, WO 2006/059229 to McGrath, et al., such as solvents consisting essentially of methanol, ethanol, 1-propanol, or 2-propanol.

It will be understood that the constituent removal processes described above are presented for purposes of illustration and that any other suitable process may be employed to remove constituents from a liquid tobacco composition.

Various processes described herein, such as dissolving tobacco in an ionic liquid, or regenerating the tobacco material, or the like, may be carried out at any suitable temperature. A suitable temperature may be determined by any of a number of factors including the melting point of the ionic liquid, acceptable temperature ranges for the processes, desired temperature ranges, or the like.

In embodiments, the step of dissolving the tobacco in an ionic liquid is carried out at a temperature above about 10° C. or above about 20° C., such as above about 30° C. In addition, or in the alternative, the dissolving step may be carried out below about 120° C., preferably below about 80° C. For example, the dissolving step may be carried out at about 60° C. By way of example, the dissolving step may be carried out at a temperature of from about 10° C. to about 120° C. or from about 30° C. to about 80° C. Higher temperatures may facilitate dissolution of tobacco in the ionic liquid. However, if temperatures are too high, the tobacco, or components of the tobacco, may degrade. The inventors have found that dissolution of tobacco in an ionic liquid at about 60° C. and subsequent regeneration resulted in little to no degradation of the tobacco or tobacco components.

Tobacco may be regenerated from a liquid tobacco composition in any suitable manner. As used herein, "regenerated" or the like, in the context of tobacco, means that at least some constituents of tobacco are separated or removed from a liquid tobacco composition in solid form. The regenerated tobacco material includes at least some cellulose component of tobacco. The liquid tobacco composition from which tobacco is regenerated may be a composition in which one or more constituents have been removed. In embodiments, selected constituents are removed during the tobacco regeneration process.

In general, regeneration of tobacco from liquid tobacco compositions includes causing cellulose and at least some other tobacco constituents to come out of solution. This can be done by, for example, altering the solubility of the cellulose and other constituents, such as by cooling, addition of a secondary solvent that is miscible with the ionic liquid but in which the tobacco constituents to be regenerated are not soluble or are less soluble, evaporation of the ionic liquid, or the like. Examples of processes that may be used to regenerate tobacco from liquid tobacco compositions include casting, extrusion into a non-solvent, ultrasonic nucleation, freezing, centrifugal separation, rotary spinning, injection into a liquid, electro-precipitation, co-precipitation on a support material, extraction by another liquid, supercritical extraction, or the like.

By way of example, tobacco may be regenerated by casting the liquid tobacco composition and washing the ionic liquid with an appropriate solvent, such as water, an alcohol, a carbonyl or other organic solvent, a supercritical fluid such as carbon dioxide, or the like, to form films of regenerated tobacco material. The casting process described in, for example, Turner et al. (2004) *Biomolecules,* 5:1379-1384, may be readily modified to produce regenerated tobacco material films.

By way of further example, tobacco may be regenerated by extruding the liquid tobacco composition into a liquid, such as water, an alcohol, a carbonyl or other organic solvent, a supercritical fluid such as carbon dioxide, or the like, in which tobacco constituents, such as cellulose, are not soluble to form fibers. An extrusion process described in, for example, Broughton et al. (2009), "Investigation of Organic Liquids for Fiber Extrusion—NTC Project: C05-AE05," *National Textile Center Annual Report*, may be readily modified to produce regenerated tobacco material fibers.

By way of yet another example, tobacco may be regenerated by rotary jet-spinning the liquid tobacco composition to produce fibers having reproducible characteristics, such as morphology, diameter and porosity. The rotary jet-spinning process described in, for example, Badrossanay et al. (2010) *Nano Lett.,* 10:2257-2261, may be readily modified to produce regenerated tobacco material fibers. In the process of Badrossanay et al., the ionic liquid solvent is evaporated, resulting in the regenerated fibers. The characteristics of the fibers can be controlled by controlling parameters of the rotary jet-spinning process.

In any of these cases, the regeneration step or steps may be performed at a temperature of at least about 0° C. In addition, or in the alternative, the regeneration step may be performed at a temperature below about 40° C., or below about 25° C. In some cases, the regeneration step or steps may be performed at a temperature between about 0° C. and about 40° C., or between about 0° C. and about 30° C. In addition to the actual regeneration, any separation processes after the regeneration step can also be performed at these temperatures.

Regardless of how the tobacco is regenerated, tobacco constituents that may remain in the washed or removed ionic liquid may be added back to the regenerated tobacco material fibers, films or the like. The ionic liquid, or composition comprising the ionic liquid, may be captured following washing, evaporation, or the like of the ionic liquid during the regeneration process. Some constituents of tobacco may remain in the recaptured ionic liquid composition. One or more of such constituents may be extracted from the recaptured ionic liquid composition by, for example, liquid-liquid or liquid-solid extraction. The extracted constituents, which may be concentrated, may then be added back to the regenerated tobacco via any suitable process, such as spraying, coating, soaking, or the like. Remaining solvent may be removed by evaporation, or the like, as desired.

The properties of the resulting regenerated tobacco material may be controlled by controlling various parameters associated with dissolving the tobacco in an ionic liquid and with regenerating the tobacco. Such parameters include the solubility of tobacco in the ionic liquid, the melting point of the ionic liquid, the solubility of the tobacco in a non-solvent or secondary solvent, temperature of dissolution, partial or full dissolution, proportion of ionic liquid and non-solvent or secondary solvent, or the like. Such parameters may be controlled to control the chemical composition of the regenerated tobacco material relative to the initial tobacco, the physical properties of the regenerated tobacco material such as size or thickness of the fibers or films, combustibility of the regenerated tobacco material, firmness of the regenerated tobacco material, or the like.

The tobacco may be regenerated in nearly any suitable form. By way of examples, regenerated tobacco material may be molded or extruded. Regenerated tobacco material fibers may be woven or non-woven as desired. Accordingly, the final shape or form of regenerated tobacco material may be is nearly limitless compared to forming and shaping of traditional tobacco shreds.

Regenerated tobacco material as described in this disclosure may be used to make any suitable tobacco product. For example, the regenerated tobacco material may be used to form a smokeless tobacco product for oral consumption, such as snuff or snus or other similar products. The regenerated tobacco material may also be used to form tobacco for roll-your-own or make-your-own applications, as well as for applications such as pipe smoking.

The regenerated tobacco material may also be used in smoking articles. Smoking articles include both conventional combustible smoking articles such as cigarettes, as well as other smoking articles in which tobacco is not combusted. Smoking articles in which the tobacco is not combusted include smoking articles that heat the tobacco directly or indirectly, or smoking articles that neither combust nor heat the tobacco, but rather use air flow or a chemical reaction to deliver nicotine or other materials from the tobacco.

In the case of combustible smoking articles such as cigarettes, the regenerated tobacco material may be used in any portion of the smoking article having a tobacco substrate, for example in the tobacco rod of a conventional cigarette, or in one or more segments of the filter of a conventional cigarette. In the case of smoking articles in which the tobacco is not combusted, the regenerated tobacco material may be used in any portion of the smoking article having a tobacco substrate.

For purposes of illustration and summary, the present disclosure described various liquid tobacco compositions and processes. In some processes, tobacco is dissolved in a solvent, such as an ionic liquid, constituents are removed from the dissolved tobacco, and the tobacco with removed constituents is regenerated. In some cases, removal of constituents and regeneration of tobacco occur in the same step or steps.

It will be understood that liquid tobacco compositions, whether the tobacco is fully or partially dissolved, may allow for enhanced chemical analysis of tobacco constituents. Currently, analysis of tobacco constituents is typically limited to analysis of compounds that are capable of being extracted or that are present in smoke when tobacco is burned. By dissolving tobacco in a solvent, such as an ionic liquid, the constituents are readily available for analysis and are not trapped by cellular structure or are not non-extractably bound to other components. A full spectrum of analysis of tobacco constituents and composition may be performed on tobacco dissolved in a solvent, which may aid in removal of certain constituents or identification of previously unknown or unidentified constituents.

In some embodiments, an increased amount of a reducing sugar is present or detectable in a liquid tobacco composition compared to the undissolved tobacco. As used herein, a "reducing sugar" is a monosaccharide or oligosaccharide that has an aldehyde group or is capable of forming an aldehyde group in solution through isomerism. In embodiments, a reducing sugar has ten or less monosaccharide units, such as eight or less monosaccharide units, five or less monosaccharide units, or three or less monosaccharide units.

All scientific and technical terms used herein have meanings commonly used in the art unless otherwise specified. The definitions provided herein are to facilitate understanding of certain terms used frequently herein.

As used in this specification and the appended claims, the singular forms "a", "an", and "the" encompass embodiments having plural referents, unless the content clearly dictates otherwise.

As used in this specification and the appended claims, the term "or" is generally employed in its sense including "and/or" unless the content clearly dictates otherwise. The term "and/or" means one or all of the listed elements or a combination of any two or more of the listed elements.

As used herein, "have", "having", "include", "including", "comprise", "comprising" or the like are used in their open ended sense, and generally mean "including, but not limited to". It will be understood that "consisting essentially of", "consisting of", and the like are subsumed in "comprising," and the like.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the disclosure, including the claims.

Non-limiting examples illustrating dissolving of tobacco in an ionic liquid, removal of tobacco constituents from the dissolved tobacco, and regeneration of tobacco from the liquid tobacco composition is described below.

EXAMPLES

In one example, dissolution of tobacco in an ionic liquid and regeneration of tobacco fibers from the ionic liquid was performed. It will be understood that other ionic liquids and conditions may be employed to dissolve tobacco and that other processes for regeneration may be employed. In this example, tobacco shreds were suspended in 1-ethyl-3-methylimidazolium acetate (a couple of shreds per ml) and slightly heated by a heating gun. Within 30 minutes, the tobacco shreds were completely dissolved in the liquid. A drop of the dissolved tobacco in the ionic liquid was placed on a slide, and a drop of water was added to the slide, and tobacco fibers were observed to be regenerated at the water/ionic liquid boundary.

In another experiment, reducing sugars were extracted from a liquid tobacco composition (tobacco shreds dissolved in 1-ethyl-3-methylimidazolium acetate) or undissolved tobacco shreds using a solution of acetic acid. Extracted reducing sugars in the acetic acid solution were reacted with p-hydroxy benzoic acid hydrazide (PAHBAH) in alkaline solution at 85° C. to generate a yellow osazone with a maximum of absorbance at 410 nm. The concentration of yellow osazone was determined via spectrophotometry. A higher concentration of reducing sugars resulted from the liquid tobacco composition relative to the undissolved tobacco shreds (data not shown).

In another experiment, ground tobacco lamina and stems ("GLS"), ground tobacco stems ("GS"), shredded tobacco stems ("SS"), or shredded tobacco lamina and stems ("SLS") were dissolved or freeze dried in 1-ethyl-3-methylimidazolium acetate ("[EMIM]AcO") at room temperature, 35° C., or 60° C. Where a temperature is not indicated in the results below, the tobacco was dissolved in the ionic liquid at room temperature. Tobacco was then regenerated from the liquid tobacco composition by adding water to the liquid tobacco composition and separating the resulting regenerated tobacco material from the liquid. The regenerated tobacco material was then washed with water to remove the remaining ionic liquid and it was then dried. The amount TSNAs in untreated tobacco (tobacco that was not dissolved in ionic liquid and not treated for removal of TSNAs) and the tobacco regenerated material from the treated liquid tobacco composition was determined by HPLC (High Performance Liquid Chromatography). Results are presented below.

Referring to FIG. 1, a bar graph showing amounts of bound and free NNK in untreated GLS and treated GLS is shown. The treated GLS was dissolved in [EMIM]AcO and treated and regenerated as described above. The NNK results are also presented in Table 1 below along with NNN results.

TABLE 1

Reduction of TSNAs from liquid tobacco compositions

| Sample | IL [EMIM]AcO | free NNN [ng/g] | free NNK [ng/g] | bound NNK [ng/g] | total NNK [ng/g] |
|---|---|---|---|---|---|
| GLS | untreated | 3997 | 1131 | 4005 | 5136 |
| GLS | Ionic Liquid Dissolved @ 35° C. | 39 | 31 | 222 | 253 |
| GLS | Ionic Liquid Dissolved @ 60° C. | 83 | 35 | 118 | 153 |

As shown in FIG. 1 and Table 1, a substantial reduction of NNN and NNK was observed following TSNA removal treatment of the liquid tobacco composition regardless of temperature. However, at higher temperatures (60° C. vs. 35° C.), it is hypothesized that the tobacco is more completely dissolved, allowing for more of the bound NNK to be released. While the results are impressive for reduction of free NNN and NNK, they are even more impressive for bound NNK, which is not possible to reduce by existing extraction and treatment techniques. An approximate 20 to 40-fold reduction in bound NNK was achieved. Such level of reduction of bound TSNAs was not previously possible using conventional extraction processes.

Referring now to Table 2 below, the yields of regenerated tobacco material produced from ionic liquid tobacco compositions at different temperatures is shown.

TABLE 2

Yields of Regenerated Tobacco Material

| Sample | Ionic Liquid | Batch No. | Theoretical Yield (%) | Practical Yield (%) |
|---|---|---|---|---|
| GLS | [EMIM]AcO | 1 | 16.9 | 15.3 |
| | | 2 | 16.0 | 14.1 |
| SLS | [EMIM]AcO | 1 | 7.4 | 6.1 |
| | | 2 | 7.9 | 6.6 |
| GS | [EMIM]AcO | 1 | 15.1 | 13.0 |
| SS | [EMIM]AcO | 1 | 6.1 | 4.9 |
| | | 2 | 6.5 | 5.4 |
| GLS | [EMIM]AcO 60 C | 1 | 46.2 | 38.5 |
| GLS | [EMIM]AcO freeze dried | 1 | 15.5 | 13.7 |

With reference to Table 2, practical yield=[(mass regenerated material)/(mass tobacco)]*100%. Theoretical yield=[(mass regenerated material)+(mass dissolved material in residual ionic liquid)]/(mass tobacco)*100%. The theoretical yield takes into account the amount of dissolved material in the residual ionic liquid which was left associated with the insoluble residue after solid-liquid separation and also possible yield losses when transferring the material from dissolution vessel to centrifugation bottle. The concentration (g/g) of dissolved material in ionic liquid is calculated and it is multiplied by the amount of ionic liquid left in the residue. The equation produces a reliable estimation of the amount of dissolved material in the residue. Theoretical yield calculation assumes 100% yield in regeneration. At times the insoluble residue remained very "wet" causing a substantial difference between theoretical and practical yields. The dry matter content of the samples after freeze drying also affect the yield results. Dry matter content was analysed from 8 freeze dried samples and it was in the range of 94.0-99.0%. For simplicity, the dry matter content of all samples was set to 96% in the yield calculations.

Temperature had a substantial impact on yield, with higher temperatures resulting in increased yields. Surprisingly, dissolving the tobacco in an ionic liquid at 60° C. resulted in about a two to three-fold increase in yield relative to room temperature. Little or no degradation of polysaccharide components was observed in the tobacco regenerated from 60° C. ionic liquid solution (data not shown), indicating that higher temperatures may be suitable to achieve increased yields without degrading tobacco components.

The invention claimed is:

1. A method for reducing a tobacco-specific nitrosamine (TSNA) in tobacco, comprising:

dissolving tobacco in an ionic liquid to obtain a liquid tobacco composition, regenerating the tobacco to produce a regenerated tobacco material having a reduced level of the TSNA relative to the tobacco that was dissolved in the ionic liquid, further comprising contacting the liquid tobacco composition with a tobacco-specific nitrosamine-reducing material, and separating the regenerated tobacco material from the liquid tobacco composition.

2. A method according to claim 1, wherein regenerating the tobacco comprises adding a second liquid to the liquid tobacco composition.

3. A method according to claim 2, wherein the second liquid is water.

4. A method according to claim 1, wherein removing the one or more constituents comprises extracting the one or more constituents from the liquid tobacco composition with a solvent for the one or more constituents.

5. A method according to claim 4, wherein the solvent for the one or more constituents is configured to extract precursor of benzo[a]pyrene.

6. A method according to claim 1, wherein the ionic liquid comprises an imidazolium salt.

7. A method according to claim 6, wherein the imidazolium salt is selected from the group consisting of a 1-ethyl-3methylimidazolium salt, a 1-butyl-3-methylimidazolium salt, and tris-(2-hydroxyethyl)-methylammonium methyl sulfate.

8. A method according to claim 7, wherein the ionic liquid is 1-ethyl-3-methylimidazolium acetate.

9. A method according to claim 1, wherein the method includes a process selected from the group consisting of ultrasonic nucleation, freezing, centrifugal separation, rotary spinning, injection into a liquid, electro-precipitation, co-precipitation on a support material, extraction by another liquid, and supercritical extraction.

* * * * *